US008408940B2

(12) United States Patent
Chang

(10) Patent No.: US 8,408,940 B2
(45) Date of Patent: Apr. 2, 2013

(54) INTEGRATED CONNECTOR

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/364,632

(22) Filed: Feb. 2, 2012

(65) Prior Publication Data

US 2012/0252245 A1 Oct. 4, 2012

(30) Foreign Application Priority Data

Mar. 28, 2011 (TW) ..... 100205463 U

(51) Int. Cl.
*H01R 13/648* (2006.01)

(52) U.S. Cl. ..... 439/607.01

(58) Field of Classification Search ..... 439/607.01, 439/607.09, 607.11, 607.32, 660
See application file for complete search history.

(56) References Cited

U.S. PATENT DOCUMENTS

2012/0040567 A1* 2/2012 Ho ..... 439/660
2012/0071032 A1* 3/2012 Tsai ..... 439/660
2012/0077370 A1* 3/2012 Lee et al. ..... 439/488
2012/0077390 A1* 3/2012 Tsai ..... 439/660
2012/0196483 A1* 8/2012 Kuster ..... 439/626

FOREIGN PATENT DOCUMENTS

TW M369570 U 11/2009

* cited by examiner

*Primary Examiner* — Tulsidas C Patel
*Assistant Examiner* — Phuongchi Nguyen
(74) *Attorney, Agent, or Firm* — Chun-Ming Shih; HDLS IPR Services

(57) ABSTRACT

The integrated connector includes an insulative body, a circuit board, eSATA interface bonding fingers, USB interface bonding fingers and USB pins. The insulative body has a trough towards a front side thereof and a plate under the trough. The plate is towards the front side of the insulative body and is formed with first openings and second openings behind the first openings. The circuit board is disposed in the trough and has a first conductive side and a second conductive side. The eSATA interface bonding fingers are disposed on the first conductive side. The USB interface bonding fingers are disposed on the second conductive side and exposed by the first openings. The USB pins are disposed in the trough and under the circuit. Each of the USB pins has a contact portion and a solder portion. The contact portions protrude from the insulative body through the second openings.

10 Claims, 5 Drawing Sheets

INTEGRATED CONNECTOR

BACKGROUND OF THE INVENTION

1. Technical Field

The invention relates to electric connectors, particularly to connectors combining USB and eSATA interfaces.

2. Related Art

With development of the semiconductor technology and internet, mass storage devices with larger capacity and faster data transfer rate become focuses of the industries. The eSATA (External Serial Advanced Technology Attachment) and USB (Universal Serial Bus) have been the most popular interfaces.

The eSATA and USB have their respective specifications and protocols, so proprietary cables and connectors were absolutely required before. However, an integrated connector which combines eSATA and USB specifications appears in the market in recent years. Taiwan patent No. M369570 discloses such an integrated connector. This connector includes: a first fixing device for fixing a first pin set and a second pin set and a second fixing device for fixing a third pin set. The two fixing devices are overlappedly accommodated in a housing. The pin sets can separately support eSATA, USB 2.0 and USB 3.0 specifications for connecting distinct cables.

The above patent uses the first and second fixing devices to fix the first pin sets (eSATA specification) and the second pin set with the third pin set (USB 2.0/3.0). It must be composed of many components and occupy a considerable space. Thus it is difficult to be applied in thin and light-weight electronic devices.

SUMMARY OF THE INVENTION

An object of the Invention is to provide an integrated connector which can serve as an eSATA, USB 2.0 or USB 3.0 plug.

Another object of the invention is to provide an integrated connector which can simplify structure and reduce volume to satisfy requirements of lightweight design. Also, the contact pins will not be shifted after long-term use.

To accomplish the objects, the integrated connector of the invention includes an insulative body, a circuit board, eSATA interface bonding fingers, USB interface bonding fingers and USB pins. The insulative body has a trough towards a front side thereof and a plate under the trough. The plate is towards the front side of the insulative body and is formed with first openings and second openings behind the first openings. The circuit board is disposed in the trough and has a first conductive side and a second conductive side. The eSATA interface bonding fingers are disposed on the first conductive side. The USB interface bonding fingers are disposed on the second conductive side and exposed by the first openings. The USB pins are disposed in the trough and under the circuit. Each of the USB pins has a contact portion and a solder portion. The contact portions protrude from the insulative body through the second openings.

In comparison with the conventional, the invention arranges eSATA bonding fingers and USB bonding fingers on two opposite sides of a circuit board so as to be capable of connecting one of eSATA and USB plugs. Such a simplified structure can shrink volume of the connector to enhance utility.

Also, the insulative body can use the plate 11 to press and fix the USB pins 30 so as to prevent the USB pins 30 from being shifted. This can effectively increase durability of the connector.

DETAILED DESCRIPTION OF THE INVENTION

Figure 1:
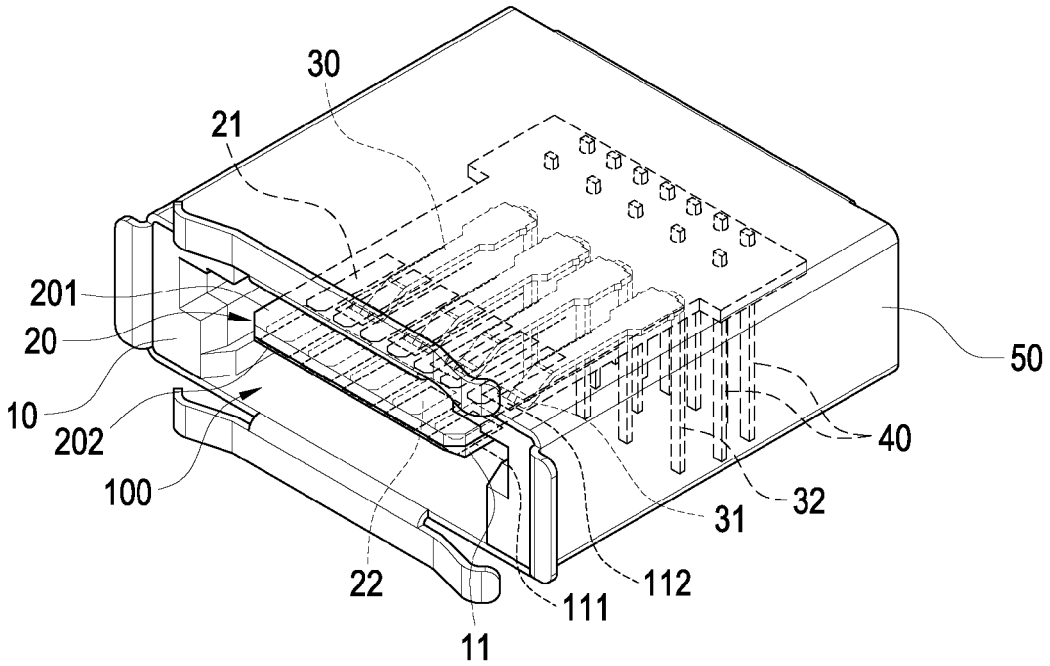
FIG. 1 is a perspective view of the invention.
Figure 2:
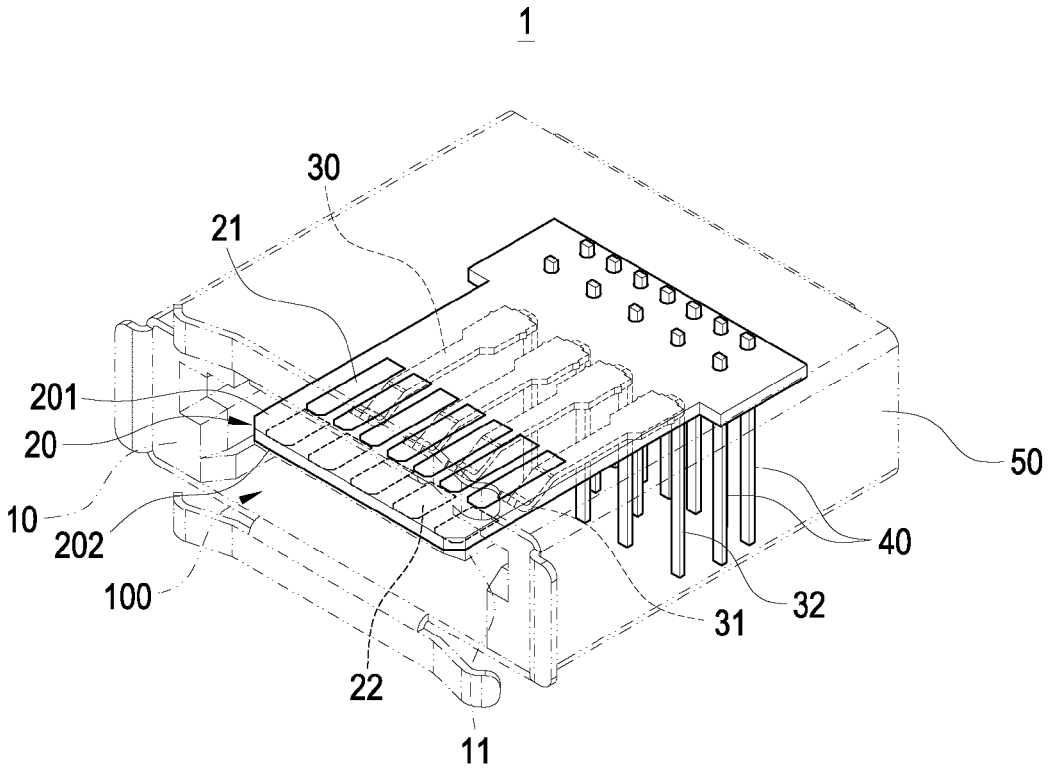
FIG. 2 is another perspective view of the invention.
Figure 3:
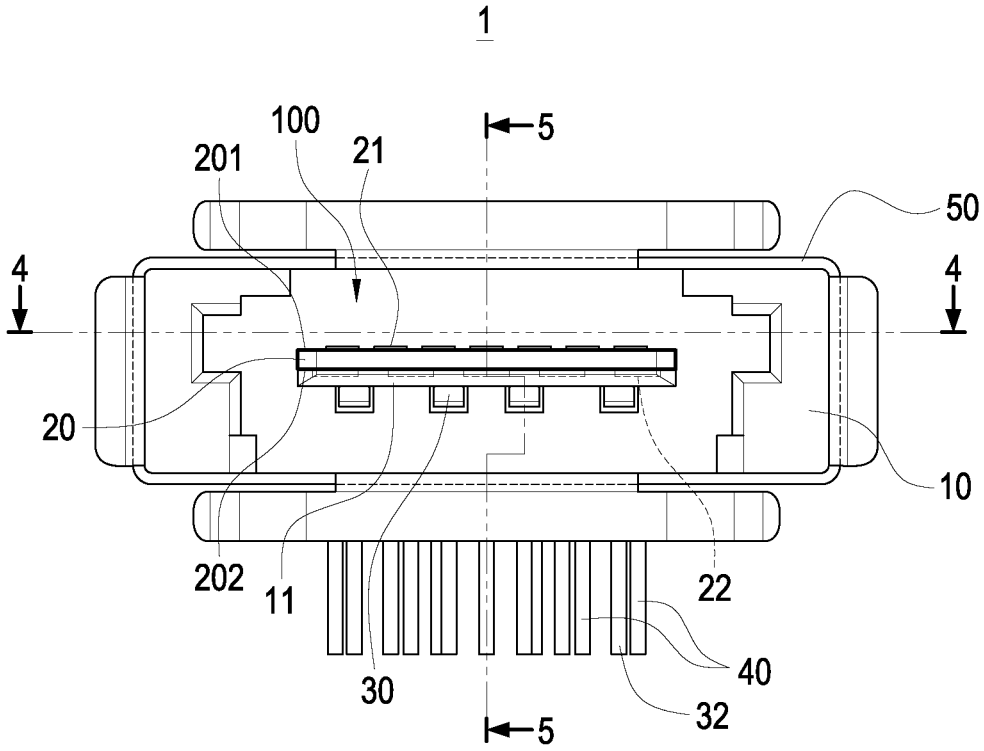
FIG. 3 is a front view of the invention.

Please refer to FIGS. 1-3. The integrated connector 1 of the invention includes an insulative body 10, a circuit board 20, a plurality of USB pins 30, a plurality of connection pins 40 and a metal housing 50.

A front end of the insulative body 10 is formed with a trough 100. A plate 11 is provided under the trough and towards the front end. The front portion of the plate 11 is formed with a plurality of first openings 111 and a plurality of second openings 112 behind the first openings 111. The circuit board 20 is horizontally placed in the trough 100. The rear end of the circuit board 20 connects the insulative body 10. The circuit board 20 has a first conductive side 201 and a second conductive side 202.

Figure 4:
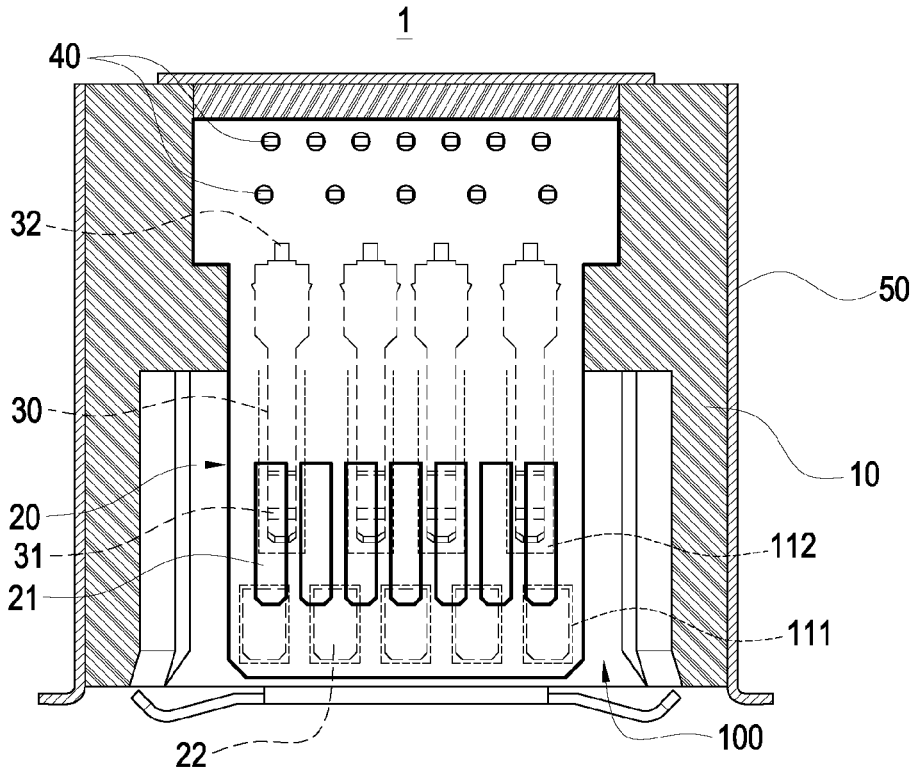
FIG. 4 is a sectional view along the line 4-4 in FIG. 3.
Figure 5:
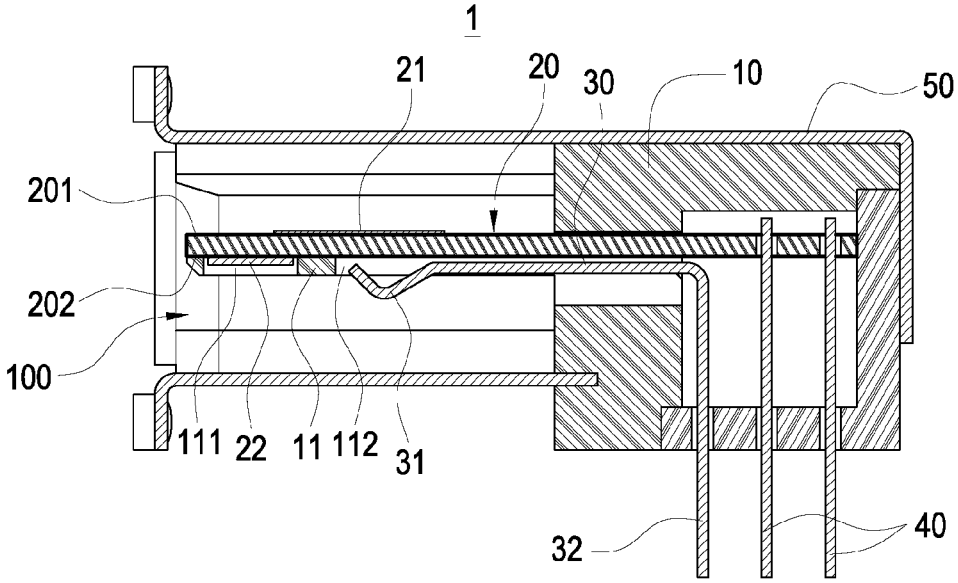
FIG. 5 is a sectional view along the line 5-5 in FIG. 3.

Please refer to FIGS. 4 and 5. The front of the first conductive side 201 is provided with a plurality of eSATA interface bonding fingers 21 which are formed by copper foil on the first conductive side 201. The number of the eSATA interface bonding fingers 21 is seven. The front of the second conductive side 202 is provided with a plurality of USB interface bonding fingers 22 which are formed by copper foil on the second conductive side 202 and exposed by the first openings 111. Thus the USB interface bonding fingers 22 can in direct contact with pins of an external plug. The first openings 111 corresponds the USB interface bonding fingers 22 in position and number. The number of the USB interface bonding fingers 22 is five and the number of the first openings 111 is five.

Figure 7:
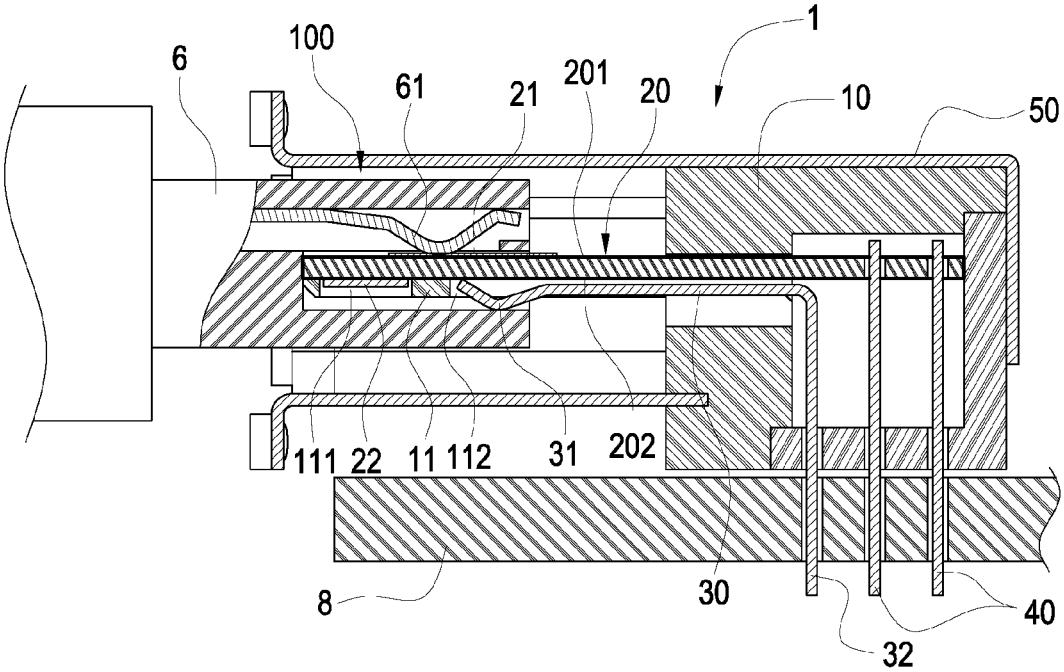
FIG. 7 is a sectional view of FIG. 6.

The USB pins 30 are located in the trough 100, under the circuit board 20 and behind the USB interface bonding fingers 22. Two ends of each the USB pin 30 are separately formed with a contact portion 31 and a solder portion 32. The solder portions 32 protrude from the rear of the trough 100 and are bent downwards. Thus the solder portions 32 protrude from the insulative body 10 to be soldered to an external circuit board 8 (as shown in FIG. 7). Also, the USB pins 30 are fastened to the insulative body 10 through the solder portions 32.

The contact portions 31 protrude from the front of the trough and from the insulative body 10 through the second openings 112. Thus the USB pins 30 can be in direct contact with pins of an external plug through the contact portions 31. Also, the insulative body can use the plate 11 to press and fix the USB pins 30 so as to prevent the USB pins 30 from being shifted. The second openings 112 corresponds the USB pins 30 in position and number. The USB pins 30 are four in number and the second openings 112 are four in number.

An end of each the connection pin 30 electrically connects the rear of the circuit board 20, the other end thereof extends from the circuit board 20 and protrudes from the insulative body 10. The connection pins 30 are electrically connected to the eSATA interface bonding fingers 21 and the USB interface bonding fingers 22 by the first conductive side 201 and the second conductive side 202, respectively. The connection pins 30 electrically connect the eSATA interface bonding fingers 21 and the USB interface bonding fingers 22 and are sixteen in number.

The metal housing 30 covering the insulative body 10 functions as electromagnetic shielding to protect the circuit board 20, USB pins 30 and connection pins 40.

Figure 6:
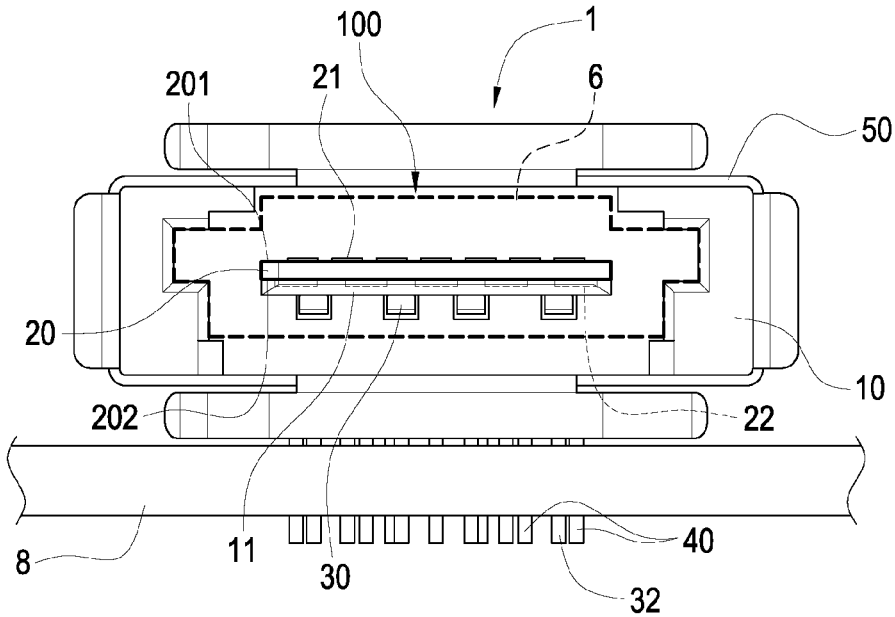
FIG. 6 is a schematic view showing the invention is connected by an eSATA plug.

Please refer to FIGS. 6 and 7. The integrated connector 1 is disposed on the external circuit board 8 and may be connected by an eSATA plug 6. The pins in the eSATA plug 6 can be in direct contact with the eSATA interface bonding fingers 21 to electrically connect the eSATA plug 6 with the external circuit board 8 when the eSATA plug 6 has plugged into the insulative body 10. It is noted that the eSATA plug 6 does not electrically connect the USB interface bonding fingers 22 and the USB pins 23.

Figure 8:
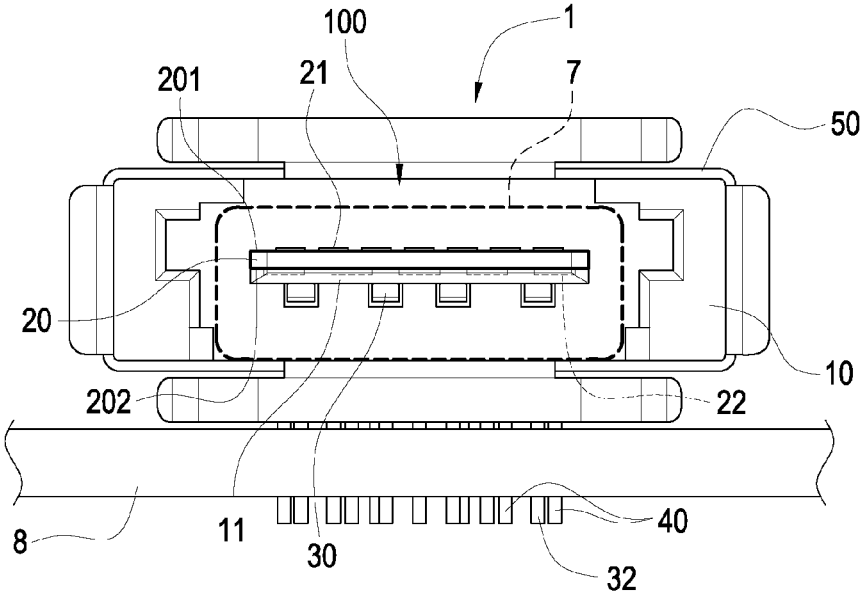
FIG. 8 is a schematic view showing the invention is connected by a USB 3.0 plug.
Figure 9:
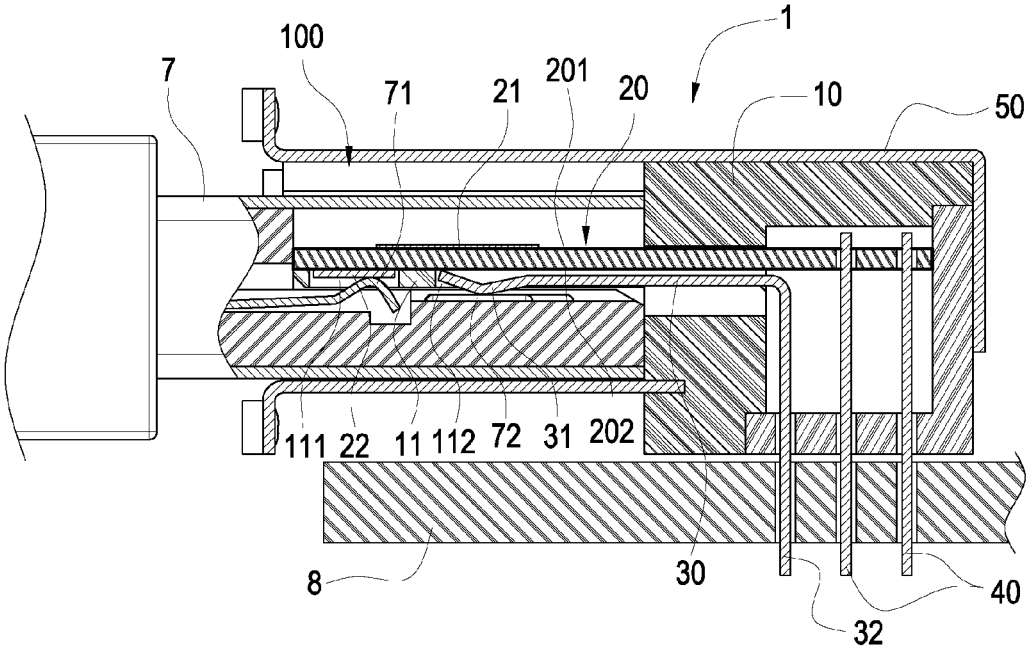
FIG. 9 is a sectional view of FIG. 8.

Please refer to FIGS. 8 and 9. Besides the abovementioned eSATA plug 6, the integrated connector 1 can also be connected with a USB 3.0 plug 7 to make data transfer via the USB 3.0 interface. The USB interface bonding fingers 22 are exposed by the first openings 111 and the contact portions 31 of the USB pins 30 protrude from the insulative body 10. As a result, the pins 71 of the USB 3.0 plug 7 can be in contact with the USB interface bonding fingers 30 and the contact portions 72 of the USB 3.0 plug 7 can also be in contact with the contact portions 31 of the USB pins 30 so as to electrically connect the USB 3.0 plug 7 with the external circuit board 8.

It is noted that the USB 30 plug 7 does not electrically connect the eSATA interface bonding fingers 21. Furthermore, the connector 1 can also connect with a USB 2.0 plug (not shown).

It will be appreciated by persons skilled in the art that the above embodiment has been described by way of example only and not in any limitative sense, and that various alterations and modifications are possible without departure from the scope of the invention as defined by the appended claims.

What is claimed is:

1. An integrated connector comprising:

an insulative body, having a trough towards a front side thereof and a plate under the trough, wherein the plate is towards the front side of the insulative body and is formed with a plurality of first openings and a plurality of second openings behind the first openings;

a circuit board, connected to the insulative body, horizontally disposed in the trough, and having a first conductive side and a second conductive side;

the plate located right underneath and abutting the circuit board;

a plurality of eSATA interface bonding fingers, disposed on and electrically connected to the first conductive side;

a plurality of USB interface bonding fingers, disposed on a front end of the second conductive side and electrically connected to the second conductive side, wherein the USB interface bonding fingers are exposed by the first openings; and a plurality of USB pins, disposed in the trough, under the circuit board and behind the USB interface bonding fingers, wherein each of the USB pins has a contact portion and a solder portion, the contact portions protrude from a front end of the trough and from the insulative body through the second openings.

2. The integrated connector of claim 1, further comprising a plurality of connection pins, wherein an end of each the connection pin connects the circuit board, and the other end protrudes from the insulative body.

3. The integrated connector of claim 2, wherein the connection pins electrically connect the eSATA interface bonding fingers and the USB interface bonding fingers through the first conductive side and the second conductive side, respectively.

4. The integrated connector of claim 3, wherein the connection pins are sixteen in number.

5. The integrated connector of claim 3, further comprising a metal housing covering the insulative body.

6. The integrated connector of claim 3, wherein the eSATA interface bonding fingers are formed by copper foil on the first conductive side.

7. The integrated connector of claim 6, wherein the eSATA interface bonding fingers are seven in number.

8. The integrated connector of claim 3, wherein the USB interface bonding fingers are formed by copper foil on the second conductive side.

9. The integrated connector of claim 8, wherein the USB interface bonding fingers are five in number.

10. The integrated connector of claim 3, wherein the USB pins are four in number.

* * * * *